US006622874B1

(12) United States Patent
Hawkinson

(10) Patent No.: US 6,622,874 B1
(45) Date of Patent: Sep. 23, 2003

(54) APPARATUS AND METHOD FOR HOLDING AND FEEDING PRODUCT

(76) Inventor: Terry Hawkinson, 8850 Apache Loop, Parker, AZ (US) 85344

( * ) Notice: Subject to any disclaimer, the term of this patent is extended or adjusted under 35 U.S.C. 154(b) by 0 days.

(21) Appl. No.: 10/008,055

(22) Filed: Nov. 13, 2001

(51) Int. Cl.[7] ..... A47F 5/00

(52) U.S. Cl. ..... 211/59.3; 211/184; 211/175; 312/71

(58) Field of Search ..... 211/59.2, 59.3, 211/184, 175; 312/61, 71

(56) References Cited

U.S. PATENT DOCUMENTS 2,652,154 A * 9/1953 Stevens
4,460,096 A * 7/1984 Ricci ..... 211/184
4,685,574 A * 8/1987 Young et al. ..... 211/59.2
4,724,968 A * 2/1988 Wombacher ..... 211/59.3
4,901,869 A * 2/1990 Hawkinson et al. ..... 211/59.3
5,024,336 A * 6/1991 Spamer ..... 211/59.2
5,542,552 A * 8/1996 Yablans et al. ..... 211/59.3
5,685,664 A * 11/1997 Parham et al. ..... 211/59.3 X
5,839,588 A * 11/1998 Hawkinson ..... 211/59.3
6,357,606 B1 * 3/2002 Henry ..... 211/59.3

* cited by examiner

*Primary Examiner*—Robert W. Gibson, Jr.
(74) *Attorney, Agent, or Firm*—Parsons & Goltry; Michael W. Goltry; Robert A. Parsons

(57) ABSTRACT

A product storage and dispensing assembly includes first and second tracks that are each capable of holding a row of product to be fed in a direction. A longitudinal engagement element is disposed adjacent a side of the first track and rows of detachably engagable longitudinal complemental engagement elements are disposed adjacent a side of the second track. The rows of the second track are different points of engagement for the engagement element of the first track, which allows the width of the second track to be adjusted as needed for allowing it to accommodate product of varying width.

14 Claims, 5 Drawing Sheets

APPARATUS AND METHOD FOR HOLDING AND FEEDING PRODUCT

FIELD OF THE INVENTION

This invention relates to apparatus and methods for storing, displaying and feeding product at points of sale and points of use.

BACKGROUND OF THE INVENTION

Shelf space is premium real estate in retail stores and supermarkets and other points of sale and points of use. As a result, skilled artisans have devoted considerable attention toward systems for holding product and feeding it forwardly to a point where it is highly visible and accessible to customers. Existing systems are efficient and usually incorporate interconnected tracks or trays that are capable of holding and feeding product forwardly. However, many stores regularly change their shelving configurations in order to add or delete products depending on demand or need. The tracks of existing systems are designed and sized to accommodate a particular size of product. If the size of the product changes, existing tracks must be removed so they can be replaced with other appropriately sized tracks. Replacing tracks of existing systems is time consuming, labor intensive, difficult and, moreover, very frustrating.

Given these and other deficiencies in the art, there is a need for new and improved apparatus for holding and feeding product that is easy to make, easy to use, inexpensive, highly efficient and that incorporate tracks that are capable of being easily adjusted for accommodating product of varying size.

SUMMARY OF THE INVENTION

The above problems and others are at least partially solved and the above purposes and others realized in improved apparatus for holding and feeding product including a track having opposing ends and opposing sides. An abutment disposed adjacent one of the ends of the track and a paddle is mounted to the track between the sides for reciprocal movement in opposition to the abutment. The paddle is biased toward the abutment. A first sidewall is positioned adjacent one of the sides of the track. An engagement element is attached to a second sidewall, and rows of detachably engagable complemental engagement elements are disposed longitudinally of the track adjacent the other of the sides of the track. The rows are very important because they provide points of engagement for engagement element of the second sidewall both toward and away from the paddle and, moreover, the first sidewall. The engagement element is a tongue and the rows of detachably engagable complemental engagement elements are rows of detachably engagable grooves. In another embodiment, the engagement is a groove the rows of detachably engagable complemental engagement elements are rows of detachably engagable tongues. The rows of detachably engagable complemental engagement elements disposed adjacent the other of the sides of the track are carried by the track. In another embodiment, the rows of detachably engagable complemental engagement elements disposed adjacent the other of the sides of the track are carried by a connector attached to the other of the sides of the track. In yet still another embodiment, the engagement element is further attached to a track that is capable of holding a row of product to be fed in a direction.

The invention also provides a product feeding assembly that includes a first track having a side and a second track having a side. The first and second tracks are each capable of holding a row of product to be fed in a direction. A longitudinal engagement element is attached to the side of the first track, and longitudinal rows of detachably engagable complemental engagement elements are attached adjacent the side of the second track. The longitudinal engagement element is a tongue the longitudinal rows of detachably engagable complemental engagement elements are rows of detachably engagable grooves. In another embodiment, the longitudinal engagement element is a groove and the longitudinal rows of detachably engagable complemental engagement elements are rows of detachably engagable tongues. The longitudinal rows of detachably engagable complemental engagement attached adjacent the side of the second track are carried by the second track. In another embodiment, the longitudinal rows of detachably engagable complemental engagement attached adjacent the side of the second track are carried by a connector attached to the side of the second track.

In a first track that is capable of holding a row of product to be fed in a direction and that has a side having an attached engagement element, the invention also provides a second track that is capable of holding a row of product to be fed in a direction and rows of detachably engagable complemental engagement elements attached adjacent a side of the second track. Where the engagement element is a tongue, the rows of detachably engagable complemental engagement elements are rows of detachably engagable grooves. Where the engagement element is a groove, the rows of detachably engagable complemental engagement elements are rows of detachably engagable tongues. The rows of detachably engagable complemental engagement elements attached adjacent the side of the second track are carried by the second track. In another embodiment, the rows of detachably engagable complemental engagement attached adjacent the side of the second track are carried by a connector attached to the side of the second track.

Consistent with the foregoing, the invention also contemplates associated methods.

BRIEF DESCRIPTION OF THE DRAWINGS

Referring to the drawings.

DETAILED DESCRIPTION OF PREFERRED EMBODIMENTS

Figure 1:
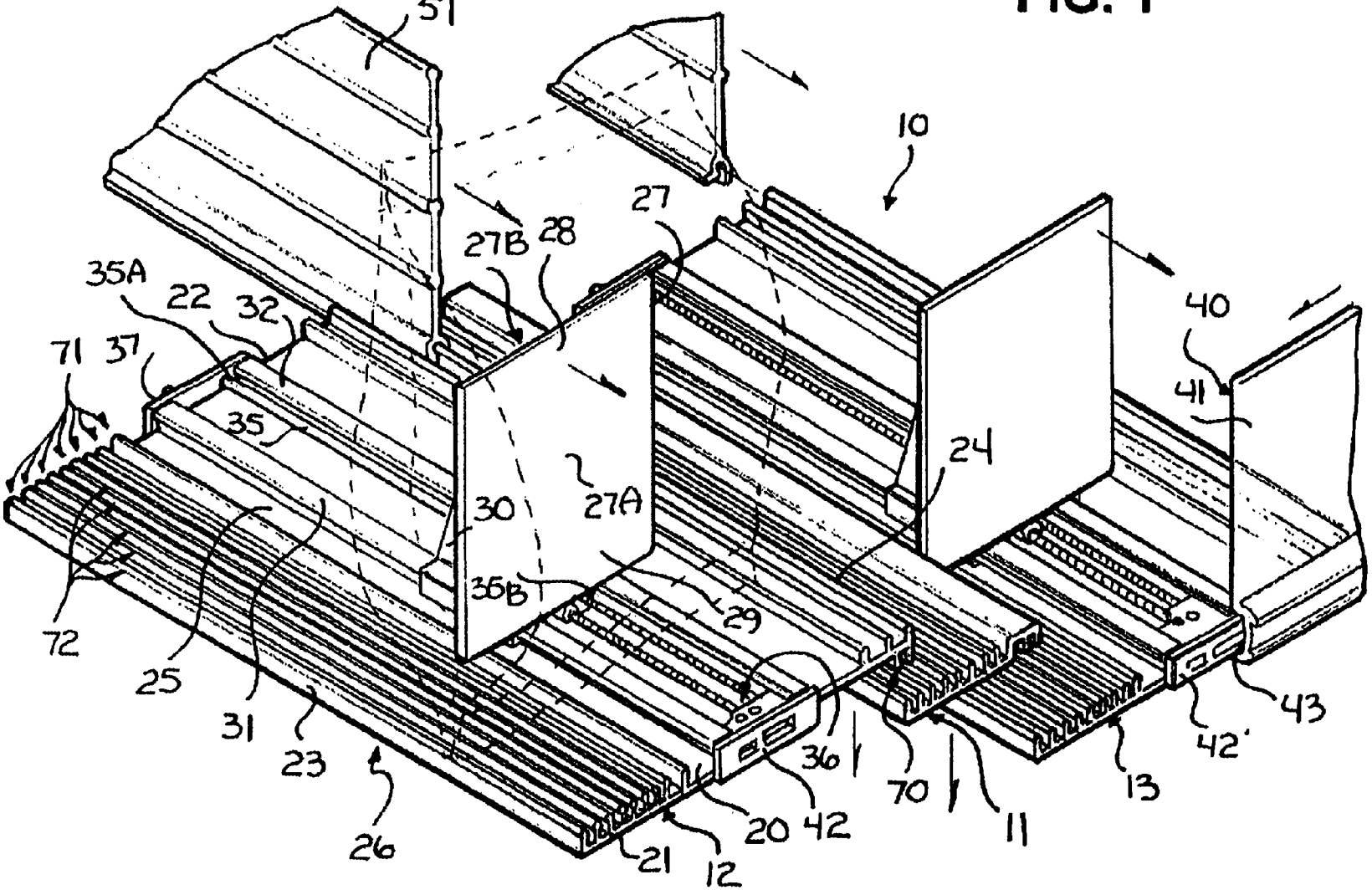
FIG. 1 is an exploded partially fragmented isometric view of an assembly for holding and feeding product, in accordance with the principle of the invention, the assembly including a connector attaching tracks that are each capable of holding a row of product to be fed in a direction.

Turning now to the drawings, in which like reference characters indicate corresponding elements throughout the several views, attention is first directed to FIG. 1 in which is seen an exploded partially fragmented isometric view of an assembly for holding and feeding product, embodying the principle of the instant invention, generally indicated by the reference character 10 and including a connector 11 attaching tracks 12,13 that are each capable of holding a row of product to be fed in a direction. The width and/or length of tracks 12,13 may vary. In structure, however, tracks 12,13 are substantially identical to one another and the structural details of only one will be discussed, namely, track 12.

Track 12 includes a base 20 having opposing ends 21,22, opposing sides 23,24 and opposing faces 25,26. A paddle 27 is mounted to base 20 between sides 23,24 for reciprocal movement in opposition to ends 21,22. Paddle 27, which can also be seen in FIG. 2, extends away from face 25 (not denoted in FIG. 2) and includes an upper end 28, a lower end 29 and opposing faces 27A,27B. A carriage 30 is attached to paddle 27. Face 27A is directed toward end 21, which is considered a forward end of track 12, and face 27B is directed toward end 22, which is considered is rearward end of track 12. Face 27A is a product engaging face. Carriage 30 extends rearwardly of face 27B in this embodiment. However, carriage 30 can face forwardly of face 27A if desired or both rearwardly and forwardly of paddle 27 as well. With regard to FIG. 1, base 20 supports spaced apart parallel rails 31,32, which are disposed at face 25 and longitudinally of base from end 21 to end 22 between sides 23,24. Rails 31,32 actually extend away from face 25. Carriage 30 is considered part of paddle 27 and is reciprocally attached to rails 31,32 for reciprocal movement in opposition to ends 21,22. Paddle 27 is capable of reciprocating along rails 31,32 from end 22 to end 21. Those skilled in the art will readily appreciate that any suitable attachment between paddle 27 and base 20 capable of permitting paddle 27 to reciprocate between ends 21,22 can be used without departing from the invention. Base 20 and paddle 27 are each constructed of plastic, ABS, styrene, polypropylene or the like and other materials can be used if desired. Base 20 and paddle 27 can each be integrally formed or assembled from two or more parts with integral formation being preferred.

Paddle 27 is biased toward end 21 of base 20. In this embodiment, a force applied to paddle 27 biasing it toward end 21 is provided by a spring 35 that is attached to base 20 and to paddle 27. Spring 35 has opposing ends 35A,35B and is a long, small-diameter helical tension spring having a large number of closely adjacent coils. End 35A is secured at end 22 of base 20 and end 35B is secured to paddle 27 and, more particularly, to carriage 30 proximate end 29 of paddle 27. End 35A is attached to a cap 37 that is fixed to end 22 of base with screws that pass into and secure end 22 of base 20. Adhesive, rivets or others selected fastening structure can be used for attaching cap 37 to end 22 of base 20, and cap 37 is considered part of base 20. Cap 37 can be integrally formed with base 20 if desired. An intermediate portion of spring 35 passes around a roller 36 that is attached to base 20 with a pin for rotation at end 21. Roller 36 is not immediately shown but is denoted generally. The intermediate portion of spring 35 passes around roller 36 in a hairpin-bend fashion. As a result, spring 35 has two runs that are generally parallel to each other and that extend longitudinally of track 12 between rails 31,32 as shown in FIG. 1. Because spring 35 is very long, it provides linear tensioning against paddle 27, biasing it toward end 21 of base. The bias applied to paddle 27 that pulls it toward end 21 is relatively constant, and the bias does not change greatly regardless of whether paddle 27 is located toward end 22 of base 20 or toward end 21 of base 20. Although a pulling force characterizes the bias applied to paddle 27, the bias can be applied with a pushing force. Although it seems hardly worth mentioning, those having ordinary skill will readily appreciate that any device or combination of devices that are capable of biasing paddle 27 toward end with pulling and/or pushing force can be used without departing from the invention including, but not limited to, one or more elastomeric elements, one or more springs, one or more piston assemblies, one or more biased linkage assemblies, etc. Also, although spring 35 provides substantially linear tensioning, mechanisms can be employed that do not provide linear tensioning. The spring 35 and roller 36 combination of the instant embodiment of the invention that biases paddle 27 toward end 21 is known and discussed in U.S. Pat. No. 5,839,588 (the '588 patent).

Figure 2:
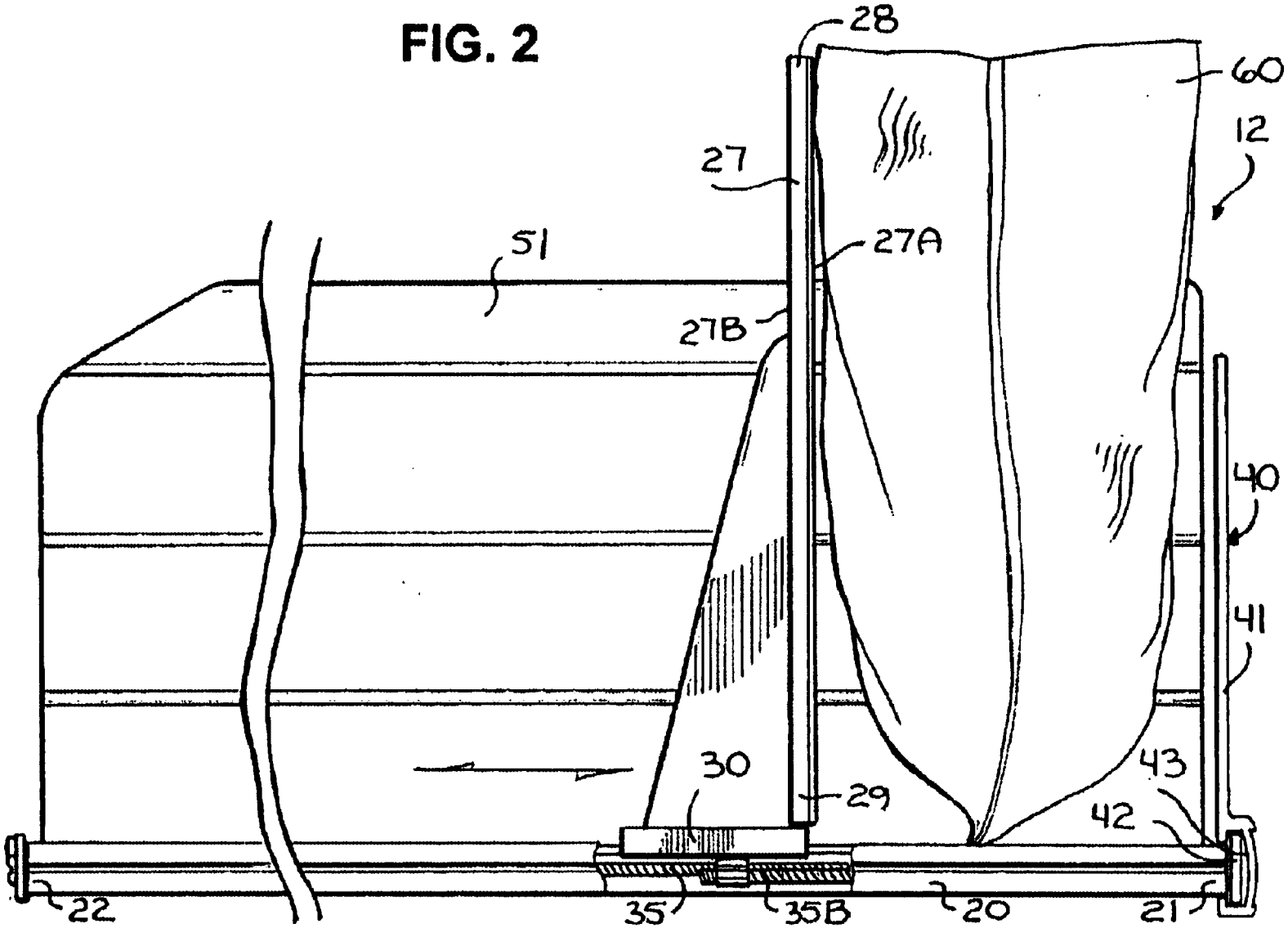
FIG. 2 is a side elevation of one of the tracks of FIG. 1 shown as it would appear furnished with product, with a portion of the track broken away for the purpose of illustration.

An abutment 40 is provided, which is capable of being positioned adjacent end 21 of track 12. Abutment 40 is constructed of plastic, ABS, styrene, polypropylene or the like and is integrally formed or assembled from two or more parts with integral formation being preferred. Abutment 40 is an elongate shield 41 that is formed of plastic, ABS, styrene, polypropylene or the like and attaches to, and extends upwardly of, end 21, and opposes or otherwise confronts face 27A of paddle 27. Shield 41 can be attached to end 21 with screws, adhesive, etc., but is preferably attached with a slide connector assembly that will be discussed presently. Abutment 40 is capable of securing the forward ends of a plurality of tracks, such as tracks 12,13. In FIG. 1, abutment 40 is shown partially attaching the forward end of track 13 as a matter of illustration. In FIG. 2, abutment 40 is shown as it would appear attached to end 21 of track 12. Although hidden from view in FIG. 2 by track 12, it will be understood that track 13 would be resting along side track 12, with the forward ends of tracks 12,13 being tied together with abutment 40.

The slide connector assembly includes a tongue 42 attached to end 21 of base and a detachably engagable groove or channel 43 attached to shield 41, and this arrangement can be reversed if desired. Tongue 42 is attached with screws, rivets, adhesive or the like, and it can be integrally formed with end 21 if desired. Channel 43 is located along a lower edge of shield 41 a slides onto and engages tongue 42, which engagement is depicted in FIG. 2. Tongue 42 is part of an attached track cap that is considered part of base 20 and to which roller 36 is attached for rotation. Roller 36 can be attached to base 20 for rotation proximate end 21 elsewhere and, more particularly, to a location other than to the track cap.

Figure 3:
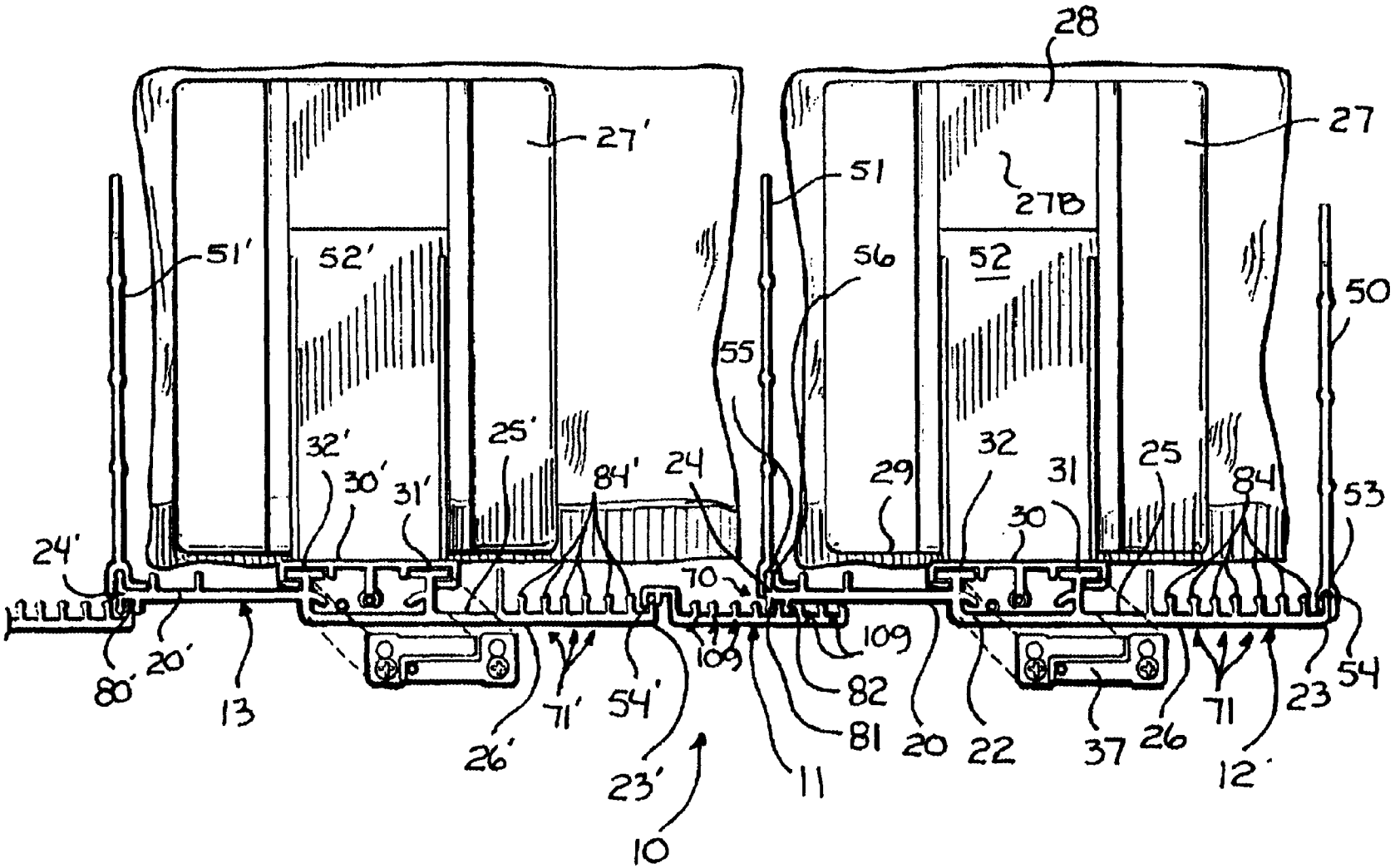
FIG. 3 is a rear end elevation of the assembly of FIG. 1, with the connector attaching the tracks.

With regard to FIG. 3, opposing parallel sidewalls 50,51 are illustrated and disposed on either side of paddle 27 at sides 23,24, respectively, defining a space .52 therebetween. Paddle 27 is disposed between sidewalls 50,51 at space 52. Preferably, sidewalls 50,51 are attached adjacent sides 23,24, respectively, extend upwardly of face 25 and extend longitudinally of base 20 along substantially the entire length thereof from end 22 to end 21. Although sidewalls 50,51 can be integrally formed with base 20 adjacent sides 23,24, respectively, or otherwise fixedly attached, they are preferably removably attached. Sidewalls 50,51 are constructed of plastic, ABS, styrene, polypropylene or the like and are integrally formed or assembled from two or more parts with integral formation, being preferred. For simplicity, tongue and groove structure removably attaches sidewalls 50,51 to base 20 adjacent sides 23,24, respectively. In this embodiment, a lower edge of sidewall 50 is furnished with an attached longitudinal groove 53 that extends along substantially the entire length of sidewall 50 and engages a corresponding tongue 54 that is attached to base 20, extends away from face 25 and that extends longitudinally of base 20 along substantially the entire length thereof from end 22 to end 21. Groove 53 slides onto and engages tongue 54. Groove 53 and tongue 54 can be constructed to snap into mating engagement if desired. The positioning of groove 53 and tongue 54 can be reversed. Referring to sidewall 51, a lower edge thereof is furnished with an attached longitudinal groove 55 that extends along substantially the entire length of sidewall 51 and engages a corresponding tongue 56 that is attached to base 20, extends away from face 25 and that extends longitudinally of base 20 along substantially the entire length thereof from end 22 to end 21. Groove 55 slides onto and engages tongue 56. Groove 55 and tongue 56 can be constructed to snap into mating engagement if desired. The positioning of groove 55 and tongue 56 can also be reversed.

In accordance with the described structure of track 12, it is capable of holding product to be fed toward shield 41 and feeding the product to shield 41 as it is removed therefrom by customers. In operation, paddle 27 is forcibly moved away from shield 41 or otherwise toward end 22 of base 20 and a row of product is positioned atop face 25 longitudinally of base 20 between face 27A of paddle 27 and shield 41, and between sidewalls 50 and 51. When paddle 27 is released from its forced manipulation, spring 35 biases it against the row of product, capturing it by and between face 27A of paddle 27 and shield 41. Product can also be pushed and loaded upon track 12 between face 27A of paddle 27 and shield 41, causing paddle 27 to be forced rearwardly away from shield 41 as the product is so loaded. Face 27A engages the rear end of the row of product, and shield 41 engages the forward end of the row of product and prevents product from being pushed outwardly from end 21. The row of product is typically bags, boxes or other form of packaged product. Unpackaged products can also be loaded onto track 12 as well. Track 12 is normally positioned on a shelf or otherwise located at a point of sale or interest and end 21 presents the product to customers. Track 12 can simply rest upon a display shelf or perhaps be attached with screws, adhesive, hook and loop attachment structure provided under the exemplary VELCRO® trademark, etc. As consumers encounter the product loaded in track 12 and remove it over shield 41, paddle 27 pushes the row forwardly so as to feed and present the product against shield 41. When the supply of product becomes diminished, track 12 is simply reloaded. As a matter of illustration, FIG. 2 shows a bag 60 located between face 27A of paddle 27 and shield 41. Shield 41 can be transparent for permitting substantially unobstructed view of the product carried by track 12. Shield 41 can also be furnished with indicia, whether advertising indicia, indicia identifying the product held by track 12, etc.

Tracks 12,13 are capable of being attached side-by-side and although only two are immediately depicted, any number can be attached side-by-side in manners that will be presently discussed. Forward ends of tracks 12,13 are capable of being tied together with abutment 40 as previously explained, by engaging abutment 40 to the forwardly positioned tongues of tracks 12,13, namely, tongue 42 of track and common tongue 42' of track 13 as shown in FIG. 1. In accordance with the invention, adjacent sides of tracks 12,13 incorporate engagement features that allow their mutual side-by-side engagement. This side-by-side engagement of tracks 12,13 is characterized by an overlapping engagement between adjacent sides of tracks 12,13. Tracks engaged side-by-side in accordance with this disclosure can each be furnished with its own dedicated attached abutment/shield if desired.

Looking to FIGS. 1 and 3, base 20 supports an attached engagement element 70 and attached parallel rows 71 of complemental engagement elements 72. Engagement element 70 is located at face 26 and disposed longitudinally of base 20 at side 24, and rows 71 are located at face 25 and disposed longitudinally of base 20 toward side 23. Although it hardly seems worth mentioning, those of ordinary skill will readily appreciate that the directions that engagement element 70 and rows 71 project can be reversed and they can even be made to project in the same direction if desired. As best seen in FIG. 3, engagement element 70 is a groove or channel 80 that is defined by parallel aspects 81,82 extending away from face 26 and longitudinally of base 20 from end 22 to end 21 (end 21 not shown in FIG. 3). Complemental engagement elements 72 are parallel tongues 84 that extend away from face 25 longitudinally of base 20 from end 22 to end 21 (end 21 not shown in FIG. 3) between rail 31 and side 23. Tongue 54 is considered one of tongues 84. In common to track 12 as referenced in FIG. 3 by common but primed reference numerals, track 13 includes base 20', sides 23',24', faces 25,26, paddle 27', carriage 30', rails 31',32', space 52' and, among other common elements, attached sidewall 51', groove 80' and rows 71' of tongues 84' (including tongue 54').

Attaching track 12 to track 13 is accomplished by disposing side 24 of track along side 23' of track 13 and engaging one of tongues 84' (which includes tongue 54') of track 13 to groove 80 of track 12. Groove 80 is capable of sliding onto and engaging each one of tongues 84' (including tongue 54'), and yet they can be constructed to snap into mating engagement if desired. Engaging groove 80 with one of tongues 84' (including tongue 54') causes an engagement between sides 24,23' of tracks 12,13, respectively, and it is preferred that the forward ends of tracks 12,13 align along a common plane for facilitating the attachment of abutment 40 to the forward ends of tracks 12,13 as previously discussed. With sidewalls 50 and 51 attached to track 12, it is important to note that attaching side 24 of track 12 to side 23' of track 13 as herein described permits sidewall 50 to function as an outermost or distal sidewall of an assembly of attached tracks and for sidewall 51 to function not only as the opposing sidewall of track 12 but also as one of the attached sidewalls of track 13, with space 52' being defined by sidewall 51 and sidewall 51'.

Rows 71' are very important because they provide points of engagement for groove 80 both toward and away from paddle 27' allowing the width of space 52' of track 13 as defined between sidewall 51 of track 12 and sidewall 51' of track 13 to be sized as desired in accordance with the size of product to be fitted into track 13 at space 52' With sidewall groove 55 of sidewall 51 attached to tongue 56 of base 20, groove 80 is considered attached to sidewall 51. Even after edges 24,23' of tracks 12,13 are attached and their forward ends tied together with abutment 40, adjusting the width of space 52' of track 13 is accomplished merely be sliding abutment 40 out of engagement with track 13, detaching groove 80 of track 12 from its attached one of tongues 84' (including tongue 54') reattaching groove 80 of track 12 with a selected one of tongues 84' (including tongue 54') so as to increase or decrease the width of space 52' of track 13 and: then reattaching abutment 40 so as to tie together the forward ends of tracks 12,13. It should also be noted that groove 53 of sidewall 50 of track 12 is capable of engaging each of tongues 84 and that tongues are each substantially identical to tongue 54, as is the case with tongues 84' and tongue 54' of track 13. Accordingly space 52 is capable of being adjusted simply by mounting sidewall 50 to a selected one of tongues 84 (including tongue 54). Because sidewall 50 (as with the other sidewalls incorporating the structure assigned to assembly 10) is not tied to abutment 40, detaching and reattaching sidewall 50 for effecting an adjustment of the width of space 52 can be made without having to detach abutment 40, such as by sliding sidewall 50 rearwardly away from shield 41 so as to free it from engagement to base 20. As the need arises, track widths can be periodically adjusted in the foregoing manners. It will be understood that rows 71 of track 12 offer different points of engagement not only for sidewall 50 for adjusting width 52, but also for an adjacent track. Any number of rows 71,71' can be employed for the purpose of offering any desired number of points of engagement.

As previously mentioned, tracks attached side-by-side in accordance with the invention can each be furnished with its own dedicated abutment/shield. In this scenario, adjacent abutments/shields of adjacent tracks would not need to function to interlock or otherwise engage together adjacent tracks. In this regard, adjusting the width of tracks attached side-by-side in accordance with the invention that are equipped with abutments/shields that do not function to tie together adjacent tracks can be made as discussed, but without having to detach the abutments/shields from the tracks.

Figure 4:
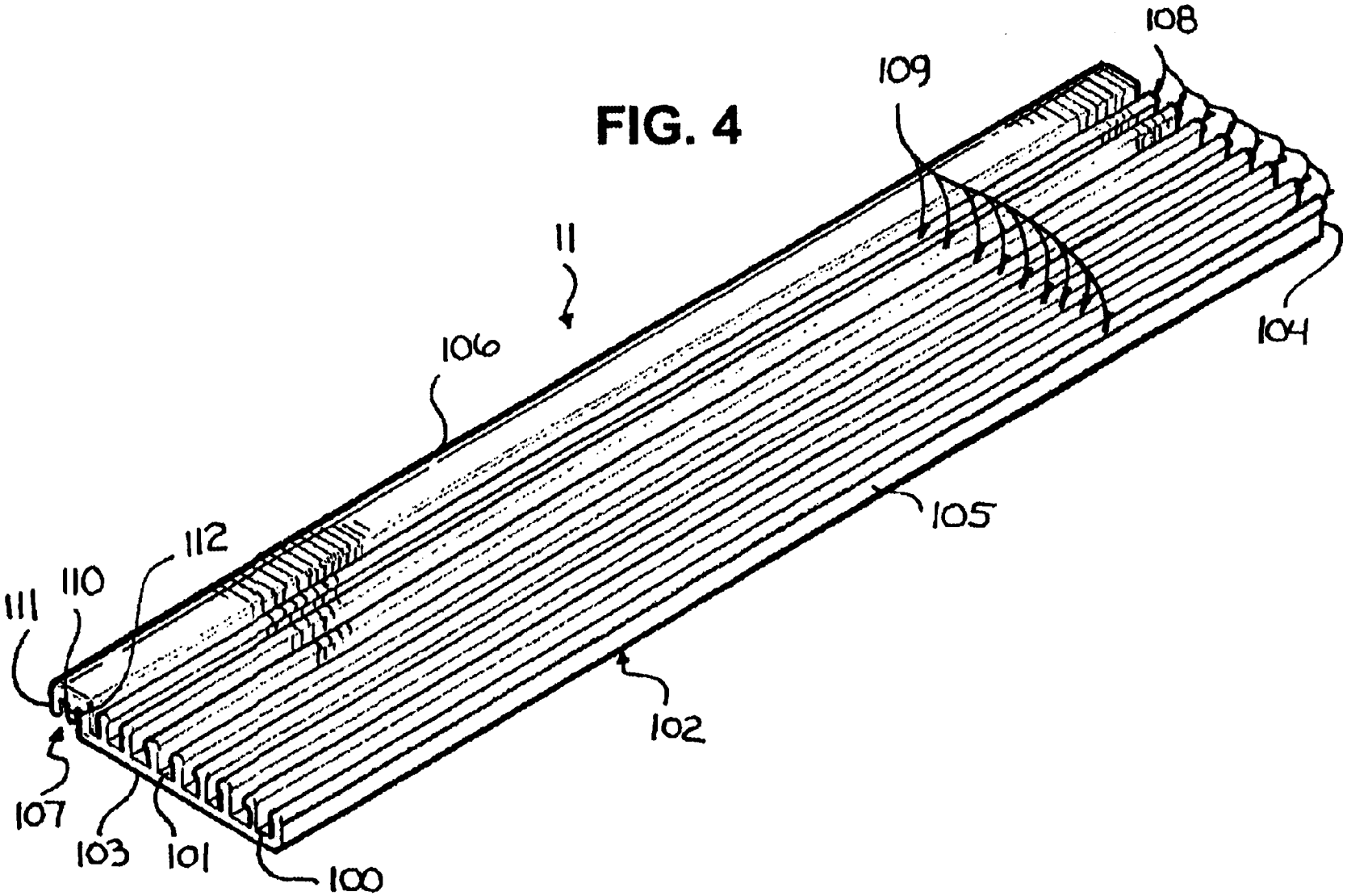
FIG. 4 is an enlarged isometric view of the connector of FIG. 1.

Connector 11 is capable of attaching track 12 to track 13 in a side-by-side orientation and, in addition to rows 71 in accordance with the principle of the invention, provides further points of engagement for groove 80 toward and away from edge 23' allowing the width of space 52' of track 13 as defined between sidewall 51 of track 12 and sidewall 51' of track 13 to be sized as desired in accordance with the size of product to be fitted into track 13. With regard to FIG. 4, connector 11 includes a base 100 having opposing faces 101,102, opposing ends 103,104, opposing sides 105,106, an attached engagement element 107 and attached parallel rows 108 of complemental engagement elements 109. Engagement element 107 is disposed longitudinally of base 100 at side 106 and faces downwardly. Rows 108 face upwardly, are located at face 101 and are disposed longitudinally of base 100 from side 105 to adjacent engagement element 107. Those of ordinary skill will readily appreciate that the directions that engagement element 107 and rows 108 project can be reversed and they can even be made to project in the same direction if desired. Because connector 11 is to provide additional points of engagement for groove 80, it is to engage tongue 54' as shown in FIG. 3 and extend outboard therefrom so as to offer points of engagement for groove 80 outboard of end 23' of track 13. Connector 11 is constructed of plastic, ABS, styrene, polypropylene or the like and other materials can be used if desired. Connector 11 can be integrally formed or assembled from two or more parts with integral formation being preferred.

In structure, engagement element 107 is common to engagement element 70 previously discussed, in that it includes a groove or channel 110 that is defined by downwardly extending parallel aspects 111,112 that extend longitudinally of base 10 from end 103 to end 104. Groove 110 attaches to tongue 54' in a manner that is identical to groove 80. In structure, complemental engagement elements 109 are common to complemental engagement elements 72 previously discussed, in that they are parallel tongues 114 that extend upwardly form face 101 and longitudinally of base 100 from end 103 to adjacent engagement element 107. Groove 80 is capable of engaging each of tongues 114 in a manner that is identical to the manner in which groove 80 is capable of engaging each of tongues 84'. In FIG. 3, groove 80 is shown as it would appear attached to an intermediate one of tongues 114. Any number of rows 108 can be employed with connector 11 for offering any desired number of points of engagement.

Even after edges 24,23' of tracks 12,13 are attached and their forward ends tied together with abutment 40, adjusting the width of the space of track 13 with connector 11 is accomplished merely be sliding abutment 40 out of engagement with track 13, detaching groove 80 of track 12 its attached one of tongues 84' (including tongue 54'), disposing side 106 of connector 11 along side 23' of track 13, attaching groove 110 to tongue 54', disposing side 24 of track 12 along side 105 of connector 11, attaching groove 80 to a selected one of tongues 114, and then reattaching abutment 40 so as to tie together the forward ends of tracks 12,13. Because connector 11 does not tie into abutment 11, adjusting width 52' of track can be made by detaching connector 11, adjusting the distance between edges 24,23' of tracks 12,13, respectively, and then reattaching connector 11. Although connector 11 is not designed to tie into abutment 40 like that of tracks 12,13, it can be configured to do so if desired. As the need arises, track widths can be periodically adjusted with connector 11 in accordance with the foregoing teachings. It will be understood that connector can be attached to side 23 of track 12 for offering not only different points of engagement for sidewall 50 for adjusting width 52, but also for an adjacent track. It should be noted that adjusting the width of tracks attached side-by-side with connector 11 in accordance with the invention that are equipped with abutments/shields that do not function to tie together adjacent tracks can be made as discussed, but without having to detach the abutments/shields from the tracks.

Figures 5, 6:
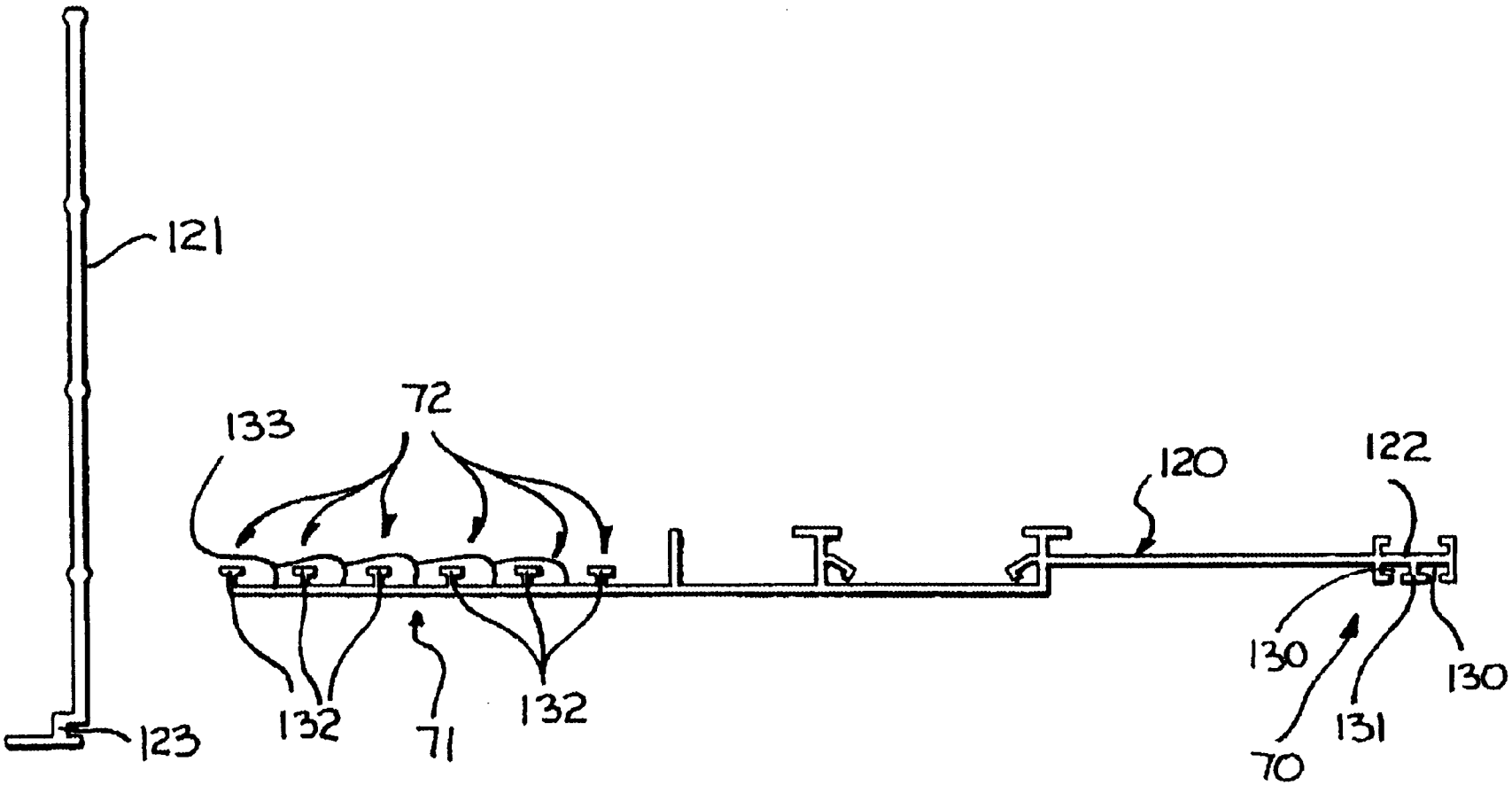
FIG. 5 is an end elevation of a base.
FIG. 6 is an end elevation of a sidewall.

The present invention is described above with reference to preferred embodiments. However, those skilled in the art will recognize that changes and modifications may be made to the described embodiments without departing from the nature and scope of the present invention. For instance, tongue and groove engagement is a predominant form of engagement structure for the various parts of assembly 10 as herein described. Any suitable tongue and groove configuration is capable of being employed. As a matter of example, FIG. 5 illustrates an end elevation of a base 120 and FIG. 6 illustrates an end elevation of a sidewall 121. Base 120 corresponds to base 20 and generally similar in structure and function, and sidewall 121 is generally similar in structure and function to each of sidewalls 50,51. FIG. 6 is a front end elevation of base 120. What is instructive of base 120 is that tongue 56 of base 20 is replaced with a slot 122 that resembles an inverted T. Slot 122 is intended to attach and hold a sidewall. Accordingly, sidewall 121 is furnished with an attached enlargement 123 that, like slot 122, resembles an inverted T and is sized to mate with and be slidingly received by slot 122.

In common with track 12, base 20 is furnished with longitudinally disposed engagement element 70 and longitudinally disposed parallel rows 71 of complemental engagement elements 72. Unlike base 20, however, engagement element 70 is pair of T-shaped grooves 130 that are partially defined and separated by an inverted T-shaped tongue 131, and complemental engagement elements 72 are parallel T-shaped tongues 132. Grooves 130 are each capable mating with and slidably receiving each of tongues 132 of an adjacent base for the purpose of linking two tracks together. Because engagement element 70 incorporates a pair of T-shaped grooves 130, less T-shaped tongues 132 are required. Between tongues 132 are slots 133 that each resemble an inverted T sized to mate with and slidingly receive enlargement 123 of sidewall 121 so as to attach sidewall 121.

Various changes and modifications to the embodiments herein chosen for purposes of illustration will readily occur to those skilled in the art and engagement pairs can be reversed. Although the various tongue and groove engagement pairs are each single features, those of ordinary skill will readily appreciate that they can each be defined by broken or separate features that are capable of cooperating as one of a given engagement element of an engagement pair. Also, although tongue and groove engagement is the predominant and preferred form of engagement structure for the various parts of assembly 10 as herein described, other suitable and complementing engagement structure can be used for permitting the capability of attaching the sides of adjacent tracks together at a plurality of different points of engagement for the purpose of adjusting track width, not the least of which include any suitable male and female engagement structure, any suitable tongue and groove configuration, etc. To the extent that such modifications and variations do not depart from the spirit of the invention, they are intended to be included within the scope thereof, which is assessed only by a proper interpretation of the following claims.

Having fully described the invention in such clear and concise terms as to enable those skilled in the art to understand and practice the same, the invention claimed is:

1. Apparatus comprising:

a track having opposing ends and opposing sides;

an abutment disposed adjacent one of the ends of the track;

a paddle mounted to the track between the sides for reciprocal movement in opposition to the abutment, the paddle biased toward the abutment;

a first sidewall positioned adjacent one of the sides of the track;

a connector attached to the other of the sides of the track;

a second sidewall;

an engagement element attached to the second sidewall; and rows of detachably engagable complemental engagement elements carried by the connector.

2. Apparatus of claim 1, wherein the engagement element comprises a tongue.

3. Apparatus of claim 2, wherein the rows of detachably engagable complemental engagement elements comprise rows of detachably engagable grooves.

4. Apparatus of claim 1, wherein the engagement element comprises a groove.

5. Apparatus of claim 4, wherein the rows of detachably engagable complemental engagement elements comprise rows of detachably engagable tongues.

6. Apparatus of claim 1, wherein the engagement element is further attached to a track that is capable of holding a row of product to be fed in a direction.

7. Apparatus comprising:

a first track having a side and a second track having a side, the first and second tracks each capable of holding a row of product to be fed in a direction;

a longitudinal engagement element attached to the side of the first track; and longitudinal rows of detachably engagable complemental engagement elements supported by a connector attached to the side of the second track.

8. Apparatus of claim 7, wherein the longitudinal engagement element comprises a tongue.

9. Apparatus of claim 8, wherein the longitudinal rows of detachably engagable complemental engagement elements comprise rows of detachably engagable grooves.

10. Apparatus of claim 7, wherein the longitudinal engagement element comprises a groove.

11. Apparatus of claim 10, wherein the longitudinal rows of detachably engagable complemental engagement elements comprise rows of detachably engagable tongues.

12. In a first track that is capable of holding a row of product to be fed in a direction and that has a side having an attached engagement element, apparatus comprising:

a second track having a side and capable of holding a row of product to be fed in a direction;

a connector attached to the side of the second track; and rows of detachably engagable complemental engagement elements carried by the connector.

13. Apparatus of claim 12, the engagement element including a tongue, wherein the rows of detachably engagable complemental engagement elements comprise rows of detachably engagable grooves.

14. Apparatus of claim 12, the engagement element including a groove, wherein the rows of detachably engagable complemental engagement elements comprise rows of detachably engagable tongues.

* * * * *